US008875795B2

(12) United States Patent
Choudhury et al.

(10) Patent No.: US 8,875,795 B2
(45) Date of Patent: Nov. 4, 2014

(54) SUBSEA SENSORS DISPLAY SYSTEM AND METHOD

(75) Inventors: Devasish Choudhury, Houston, TX (US); Zhen Liu, Houston, TX (US); Jeffrey Lambert, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 546 days.

(21) Appl. No.: 13/228,576

(22) Filed: Sep. 9, 2011

(65) Prior Publication Data

US 2012/0273211 A1 Nov. 1, 2012

Related U.S. Application Data

(60) Provisional application No. 61/480,123, filed on Apr. 28, 2011.

(51) Int. Cl.
*E21B 7/12* (2006.01)
*E21B 33/064* (2006.01)

(52) U.S. Cl.
CPC ..... *E21B 33/064* (2013.01)
USPC ..... 166/368; 166/336; 166/86.1

(58) Field of Classification Search
CPC ..... E21B 41/00; E21B 44/00; E21B 47/12
USPC ..... 166/336, 363, 368, 250.01, 66, 86.1; 251/1.1; 340/853.2
See application file for complete search history.

(56) References Cited

U.S. PATENT DOCUMENTS

| | | | | |
|---|---|---|---|---|
| 4,862,426 | A * | 8/1989 | Cassity et al. | 367/81 |
| 7,425,249 | B1 * | 9/2008 | Britton | 204/196.27 |
| 7,967,066 | B2 * | 6/2011 | McStay et al. | 166/250.01 |
| 8,353,350 | B2 * | 1/2013 | Overfield | 166/336 |
| 8,490,705 | B2 * | 7/2013 | Curtiss, III | 166/368 |
| 2007/0173957 | A1 * | 7/2007 | Johansen et al. | 700/9 |
| 2012/0197527 | A1 * | 8/2012 | McKay et al. | 702/6 |
| 2012/0275274 | A1 * | 11/2012 | Gochnour et al. | 367/134 |
| 2013/0206419 | A1 * | 8/2013 | Hallundbaek et al. | 166/341 |

* cited by examiner

*Primary Examiner* — Matthew Buck
*Assistant Examiner* — Aaron Lembo
(74) *Attorney, Agent, or Firm* — Brac ewell & Giuliani LLP

(57) ABSTRACT

Method and subsea sensors display system configured to display data about a blowout preventer (BOP) stack. The subsea sensors display system includes a display panel having plural universal subsea displays, each universal subsea display being configured to display a value measured by a sensor attached to the BOP stack; and a J-box electrically connected to the display panel and configured to provide electrical power to the display panel and to receive data from the display panel. The electrical power is provided from a pod provided on the BOP stack or from a battery when the pod is not available or from a remote operated vehicle (ROV) when connected to the display panel.

20 Claims, 10 Drawing Sheets

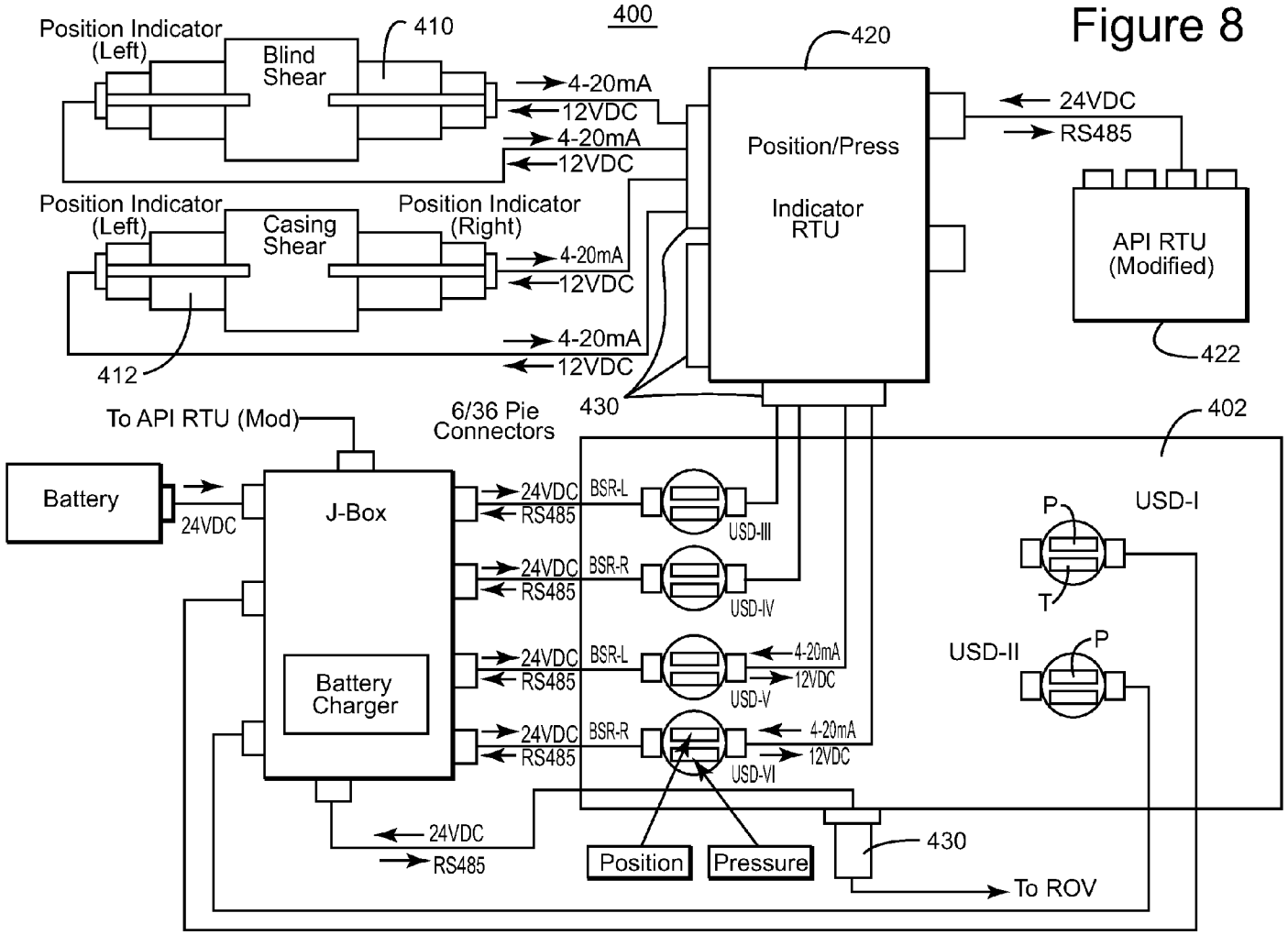
Figure 8
400
420
Position/Press
Indicator
RTU
24VDC
RS485
API RTU
(Modified)
422
402
USD-I
USD-II
P
T
P
To ROV
430
4-20mA
12VDC
4-20mA
12VDC
410
Blind
Shear
Position Indicator
(Left)
Position Indicator
(Right)
Casing
Shear
Position Indicator
(Left)
412
4-20mA
12VDC
4-20mA
12VDC
430
USD-III
USD-IV
USD-V
USD-VI
4-20mA
12VDC
4-20mA
12VDC
Pressure
Position
BSR-L
BSR-R
BSR-L
BSR-R
24VDC
RS485
24VDC
RS485
24VDC
RS485
24VDC
RS485
6/36 Pie
Connectors
J-Box
Battery
Charger
24VDC
RS485
To API RTU (Mod)
24VDC
Battery

SUBSEA SENSORS DISPLAY SYSTEM AND METHOD

CROSS-REFERENCE TO RELATED APPLICATION

This is a Non-Provisional application which claims priority under 35 U.S.C. §119(e) to U.S. Provisional Application No. 61/480,123 filed on Apr. 28, 2011 the entire contents of which are hereby incorporated by reference into the present application.

BACKGROUND

1. Technical Field

Embodiments of the subject matter disclosed herein generally relate to methods and systems and, more particularly, to mechanisms and techniques for displaying/retrieving sensor information of a subsea device.

2. Discussion of the Background

During the past years, with the increase in price of fossil fuels, the interest in developing new production fields has increased dramatically. However, the availability of land-based production fields is limited. Thus, the industry has now extended drilling to offshore locations, which appear to hold a vast amount of fossil fuel.

The existing technologies for extracting the fossil fuel from offshore fields use a System 10 as shown in FIG. 1. More specifically, the System 10 includes a vessel 12 (e.g., oil rig) having a reel 14 that supplies power/communication cords 16 to a controller 18. The controller 18 is disposed undersea, close to or on the seabed 20. In this respect, it is noted that the elements shown in FIG. 1 are not drawn to scale and no dimensions should be inferred from FIG. 1.

FIG. 1 also shows a wellhead 22 of the subsea well and a drill line 24 that enters the subsea well. At the end of the drill line 24 there is a drill (not shown). Various mechanisms, also not shown, are employed to rotate the drill line 24, and implicitly the drill, to extend the subsea well.

However, during normal drilling operation, unexpected events may occur that could damage the well and/or the equipment used for drilling. One such event is the uncontrolled flow of gas, oil or other well fluids from an underground formation into the well. Such event is sometimes referred to as a "kick" or a "blowout" and may occur when formation pressure inside the well exceeds the pressure applied to it by the column of drilling fluid. This event is unforeseeable and if no measures are taken to prevent it, the well and/or the associated equipment may be damaged. Although the above discussion is directed to subsea oil exploration, the same is true for ground oil exploration.

Thus, a blowout preventer (BOP) might be installed on top of the well to seal the well in case that one of the above mentioned events occurs and threatens the integrity of the well. The BOP is conventionally implemented as a valve to control the pressure either in the annular space between the casing and the drill pipe or in the open hole (i.e., hole with no drill pipe) during drilling or completion operations. More recently, a plurality of BOPs has been installed on top of the well for various reasons. FIG. 1 shows two BOPs 26 or 28 that are controlled by the controller 18.

The BOPs are provided in a BOP stack 45 as shown in FIG. 2. Other equipment is also provided on the BOP stack 45, e.g., MUX POD 40 or 42, etc. The MUX POD is configured to communicate with the vessel 12 and also with the BOPs and other equipment present on the BOP stack 45. The information "communicated" may include electrical signals and/or hydraulic pressure. Most of the electrical signal are originally transmitted from the surface, i.e., from the rig or vessel, by the operator of the well. The electrical signals are directed to the MUX POD (see elements 40 and 42 in FIG. 2), a component of the BOP stack that is usually provided on a Lower Marine Riser Package (LMRP) part 44 of the BOP stack 45. For redundancy purposes, two MUX PODs 40 and 42 are provided on the BOP stack 45. The BOP stack 45 also includes a lower BOP part 46 that includes various BOPs 26 and 28. The LRMP part 44 is detachably attached to the lower BOP part 46. The LRMP part 44 is attached to an end of a marine riser 49 that goes to the vessel 12. The lower BOP part 46 is traditionally attached to the wellhead 22 of the well (not shown).

Various sensors and valves are provided on the BOP stack to monitor its status and the surrounding environment. Information associated with the sensors and valves need to be provided to the operator on the vessel for controlling the BOP stack. Thus, as shown in FIG. 3, a traditional arrangement 80 has the information provided to the MUX POD 82 or 84 (and then to the operator) from sensors 86 and 88 through a remote terminal unit RTU 90. Voltage is provided from the MUX POD to the RTU unit 90 and sensors 86 and 88.

However, in case of an unexpected loss of control of the MUX POD, for example, explosion of the rig or vessel, even when all information related to the BOP stack is lost the sensors and/or valves are still functional and able to generate the information.

Therefore, it is desired to provide a capability to overcome the above noted problems.

SUMMARY

According to one exemplary embodiment, there is a subsea sensors display system configured to display data about a blowout preventer (BOP) stack. The subsea sensors display system includes a display panel having plural universal subsea displays, each universal subsea display being configured to display a value measured by a sensor attached to the BOP stack; and a J-box (junction box) electrically connected to the display panel and configured to provide electrical power to the display panel and to receive data from the display panel. The electrical power is provided from a pod provided on the BOP stack or from a battery when the pod is not available or from a remote operated vehicle (ROV) when connected to the display panel.

According to another exemplary embodiment, there is a subsea sensors display system configured to display data about a blowout preventer (BOP) stack. The subsea sensors display system includes a display panel having plural universal subsea displays, each universal subsea display being configured to display a value measured by a sensor attached to the BOP stack; a J-box electrically connected to the display panel and configured to provide electrical power to the display panel and to receive data from the display panel; a battery connected to the J-box; and plural sensors connected to the display panel. The electrical power is provided from a pod provided on the BOP stack or from the battery when the pod is not available or from a remote operated vehicle (ROV) when connected to the display panel.

According to still another exemplary embodiment, there is a method for displaying measurements associated with sensors provided on a blowout preventer (BOP) stack. The method includes a step of providing electrical power from a battery or a remove operated vehicle (ROV) to a J-box when a pod of the BOP stack is not available; a step of transmitting the electrical power from the J-box to a display panel; a step of activating the display panel with the ROV; a step of transmitting the electrical power from the display panel to plural sensors after being activated by the ROV; a step of receiving readings from the plural sensors to the display panel; and a step of displaying the reading on universal subsea displays mounted on the display panel. The system is also capable of transmitting the sensor data through the ROV connection as a RS485 feed that can be transmitted to the surface through the ROV and accessed with a laptop provided with required software.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 8 is a schematic diagram for providing plural data to an operator and to a display panel;

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a BOP stack having a MUX POD undersea. However, the embodiments to be discussed next are not limited to these systems, but may be applied to other BOPs that may be used, for example, inland.

Reference throughout the specification to "an exemplary embodiment" or "another exemplary embodiment" means that a particular feature, structure, or characteristic described in connection with an embodiment is included in at least one embodiment of the subject matter disclosed. Thus, the appearance of the phrases "in an exemplary embodiment" or "in another exemplary embodiment" in various places throughout the specification is not necessarily referring to the same embodiment. Further, the particular features, structures or characteristics may be combined in any suitable manner in one or more embodiments.

According to an exemplary embodiment, a new or an existing BOP stack may be configured to provide data indicative of the state of the stack even when a MUX POD is out of order. A subsea display system may be implemented (added, retrofitted, built) on the BOP stack for providing access to desired sensors of the stack in case that power and/or communication through the MUX POD is lost. In one application, a remote operated vehicle (ROV) is used to either connect to the subsea display system for retrieving the sensor data or to retrieve the data without physical contact with the subsea display system.

Figure 4:
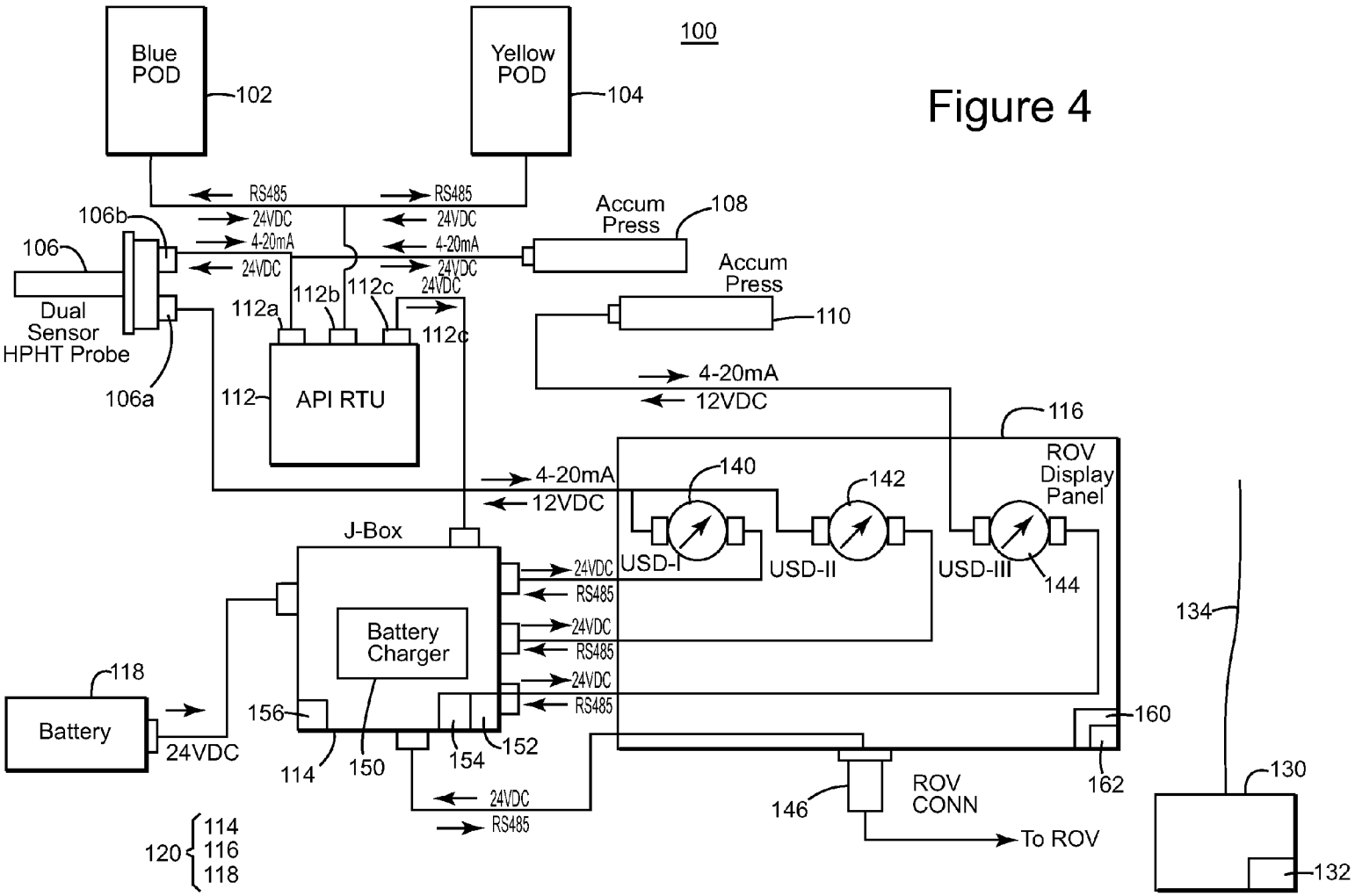
FIG. 4 is a schematic diagram of a novel arrangement for collecting and displaying sensor data according to an exemplary embodiment.

According to an exemplary embodiment illustrated in FIG. 4, a system 100 includes MUX POD units 102 and 104, sensors 106, 108 and 110, an RTU unit 112, a J-box 114, a display panel 116 and a battery 118. In one application, the display panel 116 and the J-box 114 form a subsea sensors display system 120. In another application, the battery 118 is part of the subsea sensors display system 120.

Figure 1:
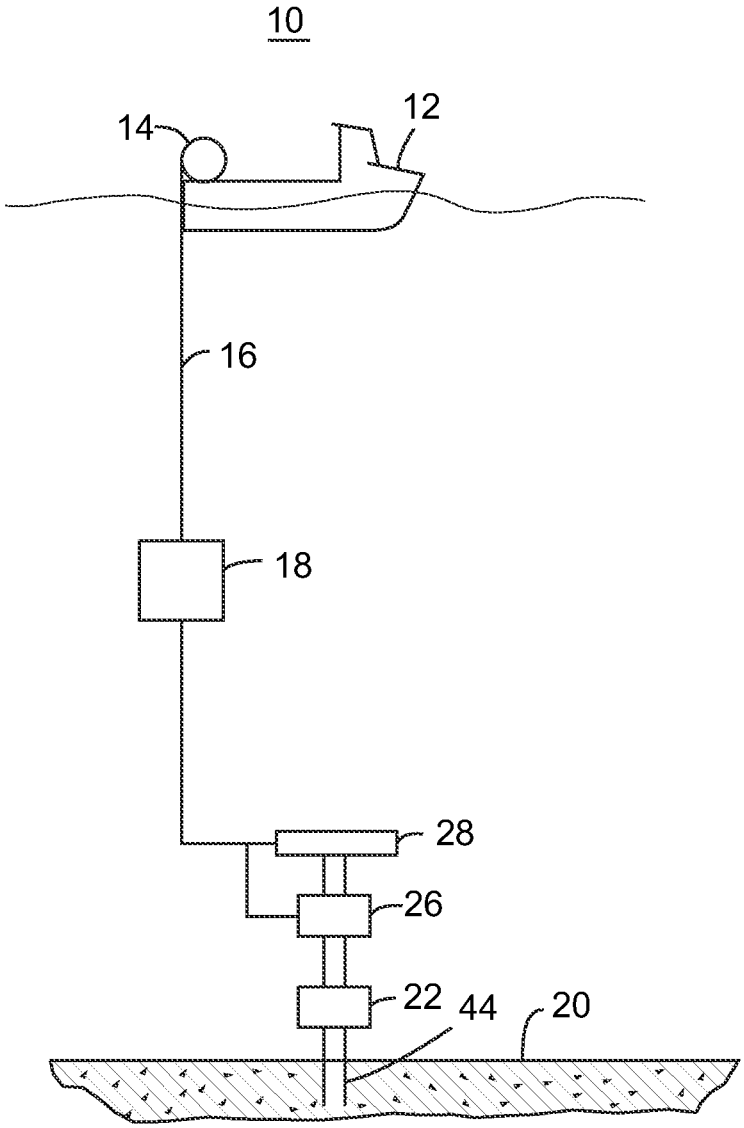
Figure 1 Background Art
FIG. 1 is a schematic diagram of a conventional offshore rig.
Figure 2:
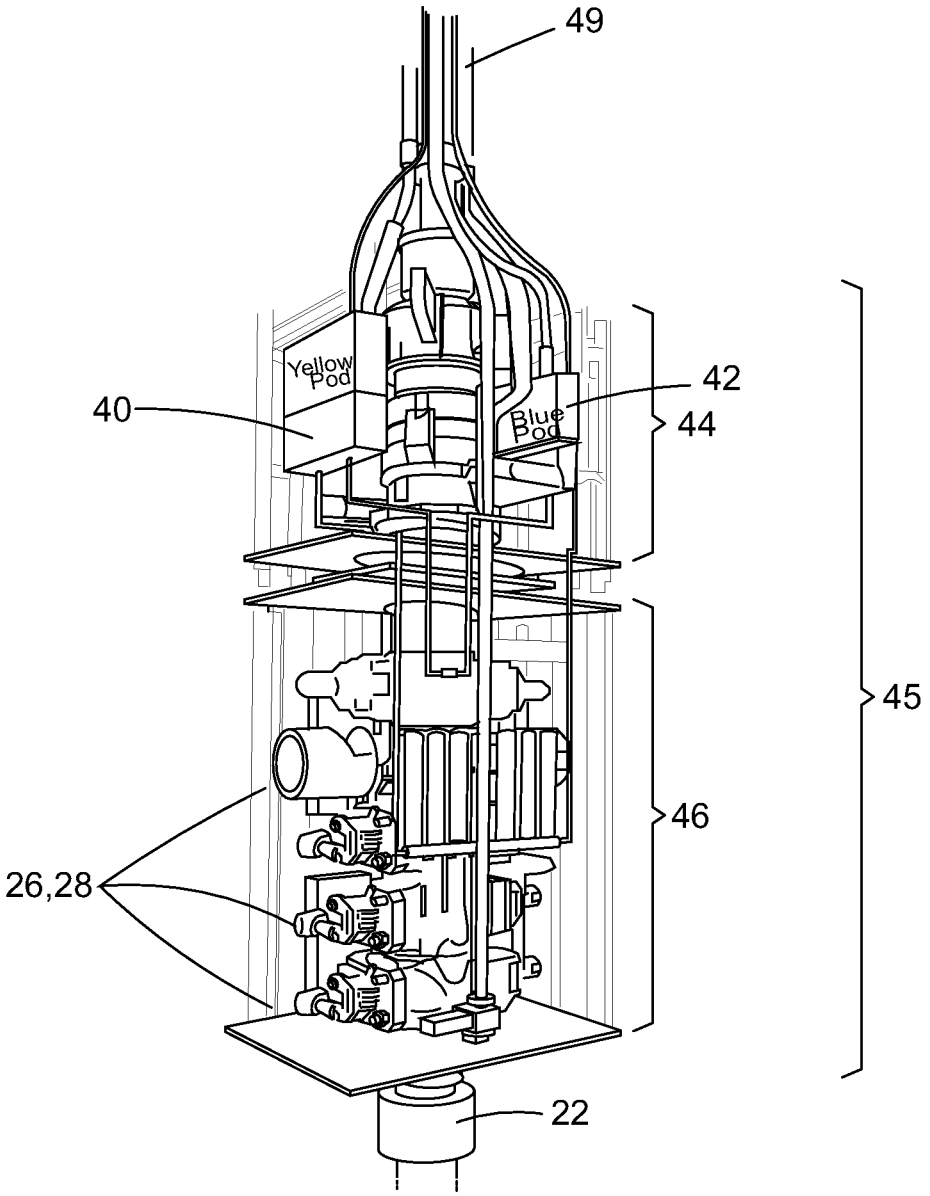
Figure 2 (Background Art)
FIG. 2 is a schematic diagram of a traditional BOP stack.
Figure 3:
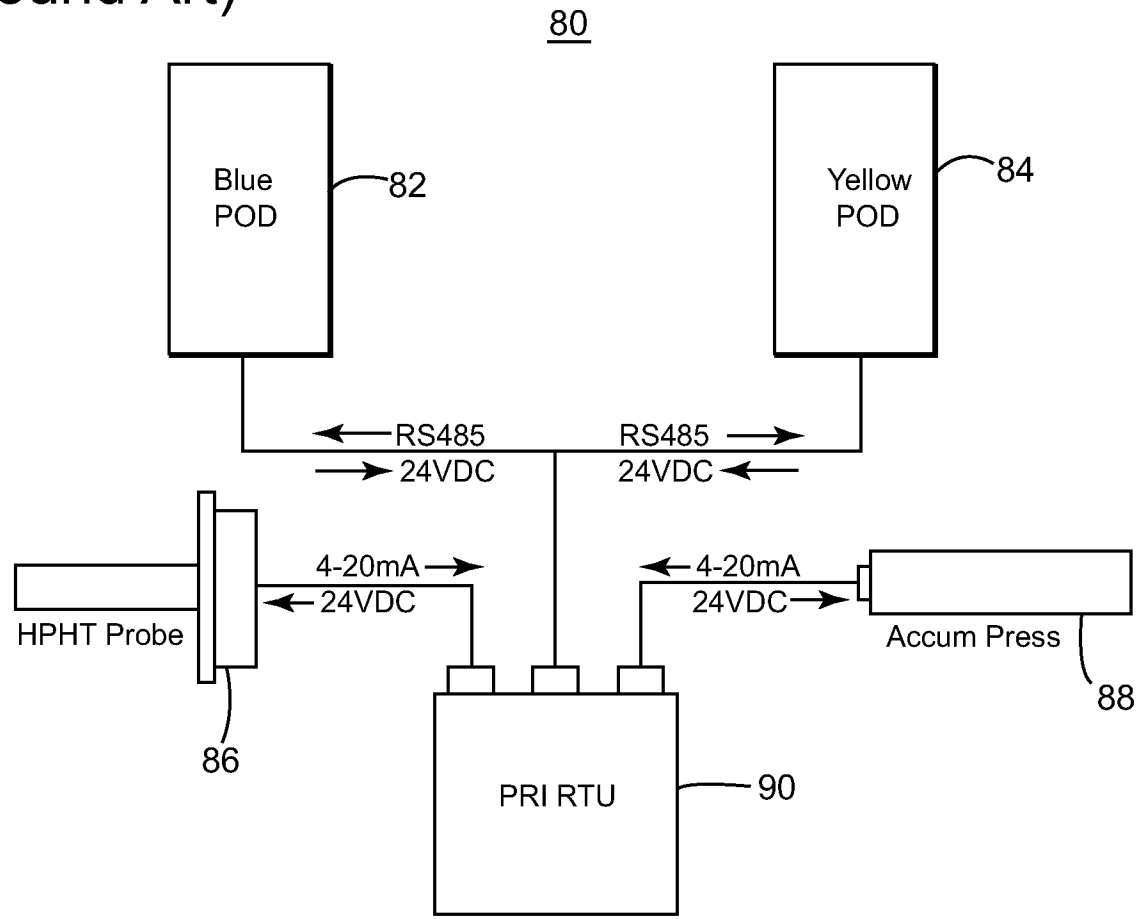
Figure 3 (Background Art)
FIG. 3 is a schematic diagram of an arrangement for collecting sensor data.

Sensor 106 in FIG. 4 has been modified relative to a traditional sensor 86 in FIG. 3, so that there are two outputs 106*a* and 106*b* which are isolated from each other. The information provided by the two outputs is almost identical as they are measuring the same physical data with the same probe. One output 106*b* is connected to the RTU unit 112 while the other output 106*a* is connected to the subsea sensors display system 120. In this way, the information to be displayed by the subsea sensors display system 120 is independent of the MUX POD and/or the connection between the sensor 106 and the MUX POD. In this exemplary embodiment, the sensor 106 is a dual sensor, i.e., it is configured to measure a pressure and a temperature associated with the BOP stack. However, a single sensor 108 may also be monitored by the subsea sensors display system 120. For example, an additional identical sensor 110 may be provided to measure the same parameter (e.g., a pressure in an accumulator) as the sensor 108. Thus, this additional sensor may be wired directly to the subsea sensors display system 120 as shown in the figure. In one exemplary embodiment, each critical sensor of the BOP stack is configured to provide a duplicate sensor output for the subsea sensors display system 120 or a duplicate sensor is provided for the critical sensors and the duplicate sensors are connected directly to the subsea sensors display system 120. Thus, the subsea sensors display system 120 may access the same data as the MUX POD. Alternatively, the signal from a single source could be duplicated inside an RTU as is done with the Position Indicators inside the Position Indicator RTU using electrical circuit manipulation. One signal is sent to the API RTU 112 and the other sent to the subsea sensor display system 120.

FIG. 4 shows that sensors 106 and 108 are connected to a terminal 112*a* of the RTU unit 112. The RTU unit 112 is also connected via a terminal 112*b* to the MUX PODs 102 and 104. The RTU unit 112 is configured to provide voltage (e.g., 24V DC) to the sensors so that the sensors can function and to receive signals (measurements) from the sensors. The voltage is provided to the RTU by the MUX POD at terminal 112*b* and the RTU unit may use the same terminal to provide RS485 signals related to the measurements of the sensors to the MUX PODs. The RTU unit 112 may be configured to have another terminal 112*c* to provide voltage to the J-box 114.

As noted above, the subsea sensors display system 120 may include the display panel 116 and the J-box 114. The display panel 116 may be configured to have the default status as inactive, i.e., minimal power is consumed and no data is displayed in order to conserve the battery energy. However, when a need arises for reading the data, the ROV 130 may approach the display panel 116 and shine light on it to activate the display gauges 140, 142 and 144 mounted on the display panel 116. Such display gauges are produced by Perry Slingsby Systems (Houston, Tex.) and have a power input of 3.5V to 35V, have a depth rating of 4000 m, are configured to accept a sensor input of 4 to 20 mA analog current, and are designed to work with sensors related to pressure, proximity, potentiometer, rotary/linear encoders and strain gauge bridges (or equivalent).

Thus, such a display panel 116 has various display gauges or universal subsea display (USD) units 140, 142, and 144, each configured to display a value measured by a corresponding sensor. The display panel 116 may have any number of USDs. The ROV may connect to the display panel via a wet-made connector 146 so that data can be transferred (e.g., via a RS485 signal) to an internal memory 132 of the ROV 130 or directly transferred to the surface via a cable 134 and viewed, for example, on a laptop equipped with relevant software.

As the subsea sensors display system 120 is configured to operate as an alternative system when the regular MUX POD system fails, this system may be equipped with the battery 118 or may be provided with electrical power directly from the ROV 132. For these cases, the subsea sensors display system 120 is configured to power up the sensors 106 and 110. The battery 118 may be recharged either through the ROV or when the MUX POD is available. The battery 118 may be a seabattery power module as those produced by Deepsea Power & Light (San Diego, Calif.), e.g., type 24V-40AH, having a molded polyethylene case and having a depth rating of 11,000 m.

The J-box 114 is connected between the RTU unit 112 and the subsea sensors display system 120. The J-box is configured to provide the RS485 signals from the USDs 140, 142 and 144 to the wet-mate connector 146, to provide electrical power from the wet-mate connector to the subsea sensors display system 120, or the battery 118 or the sensors 106 and 110 or any combination of these elements. The J-box is configured to control the power and communications flow to and from different components of the system 100 and may be handled by a printed circuit board housed inside the junction box 114. Also, the J-box may have a module 150 that controls the charging voltage of the battery 118, a module 152 for shut-off of the battery or the system 120, and a module 154 for temperature adjustments (related to the ocean depth). The J-box may be implemented in software, hardware or a combination thereof as will be discussed later.

Figure 5:
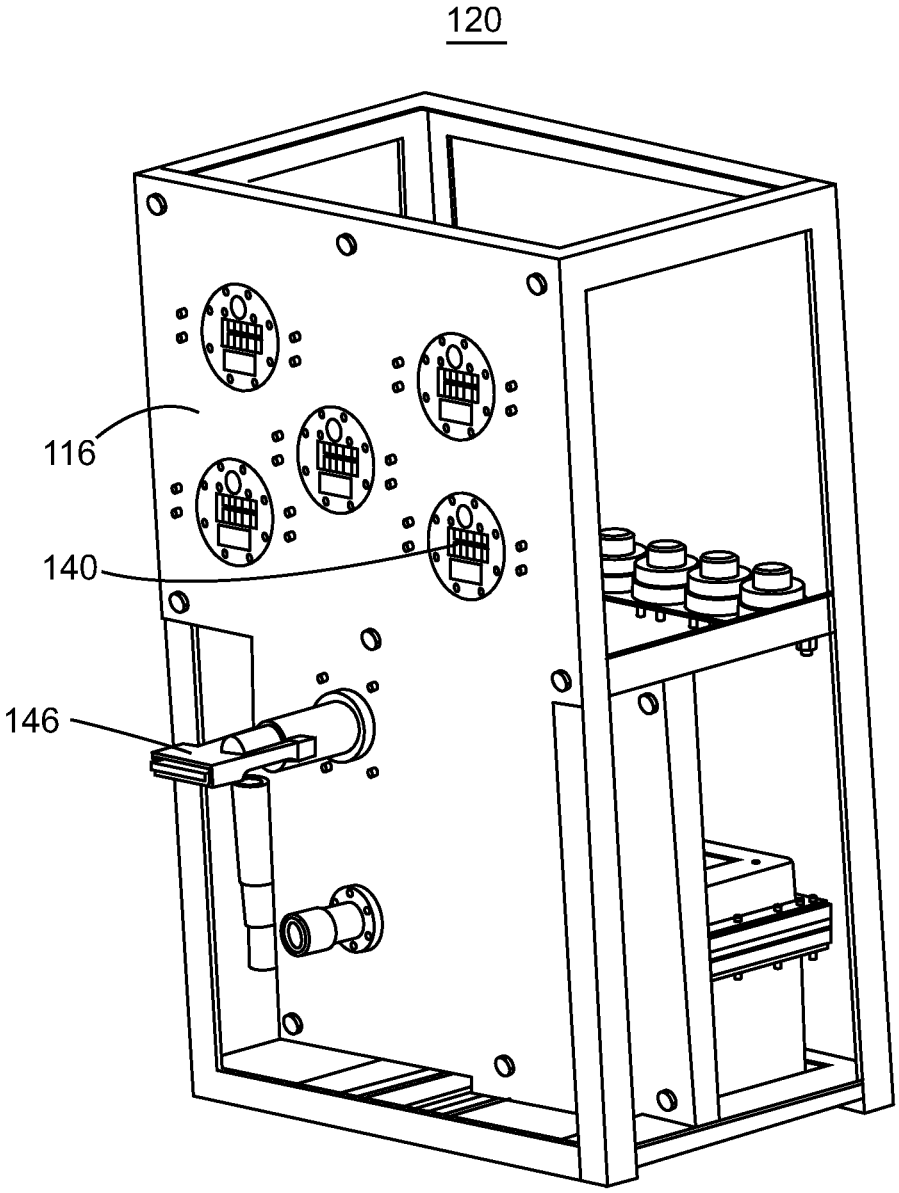
FIG. 5 is a schematic diagram of a display panel configured to display sensor data when a pod is not available according to an exemplary embodiment.

The subsea sensors display system 120 is shown in more details in FIG. 5. The display system 120 may be made of angles and plates and coated with appropriate paint (e.g., steel, hemps 2.402 or other materials) that are able to withstand high pressures and a corrosive environment. The display system 120 includes the display panel 116, the USD 140, the ROV connection 146. The battery 118 and the J-box 114 may be mounted on the back of the display panel 116. However, in another embodiment, the display panel 116, the J-box 114 and the battery 118 may be mounted at any location on the BOP stack. In one application, the display system 120 may be mounted on the lower BOP stack.

The J-box 114 is also configured to detect when the MUX POD 102 and/or 104 fails and to take appropriate action. For example, when the MUX PODs fail, the J-box 114 is configured to automatically provide energy from the battery 118 to the display panel 116 and/or sensors 106 and 110. The amount of time during which energy is provided from the battery varies, from minutes to hours and will depend upon the capacity of the battery and the number of components that draw power from it. After a predetermined time (e.g., five minutes), the display panel 116 is configured to shut down which also determines the shutdown of sensors 106 and 110. These operations may be controlled by module 154 of the J-box 114 or preset before the deployment of the unit subsea.

In one application, a storage device (data logger) may be provided on the BOP stock (e.g., the J-box) and configured to receive the information from the sensors when the MUX PODs have failed and store this data for later retrieval via the ROV.

After a certain time, the ROV 130 arrives at the display panel 116. The ROV may be configured to activate the display panel 116, for example, by shining light on a certain area 160 of the display panel 116. This area may include a light sensor 162. Alternatively, each individual USD may be equipped with light sensors which can be activated by the ROV by shining light above a certain thresh hold value. Other mechanisms may be envisioned, e.g., acoustic sensor, mechanical touch, etc. Once activated, the display panel 116 provides voltage to the sensors so that the sensors can perform their measurements. It is noted that although FIG. 4 shows that the USDs 140, 142 and 144 receive as input 24V DC and provide as output 12V DC, these values are not limiting but provided as an example. The USDs may receive a variable voltage input and may provide one or more voltage outputs depending on the configuration of the system. Other values for the voltages are possible.

After the sensors have been powered (from the RTU 112 or from the battery 118 or from the ROV 130 via the display panel 116), the results are displayed, e.g., digitally, on the USD 140, 142, 144. The ROV may read these values by using a video camera, in which case no direct connection between the ROV and the display system 120 is necessary. Alternatively, if the connection 146 has been made, the ROV may directly connect to the display system 120 and may start to download the measured values on a local storage device 130 or provide the readings directly to the vessel above through cable 134. The display system 120 may be configured to read the analog output of the sensors and convert it into an RS485 signal to be provided to the ROV. The J-box houses the connectors and a circuit board that includes modules 152 and 154. The internals of the junction box may be housed in an enclosure maintained at 1 atm pressure or could be oil filled pressure compensated to prevent sea water from contacting the circuit board.

If the ROV connects to the display system 120, the battery 118 is charged from the ROV and also the display panel 116 and the sensors are configured to receive electrical power from the ROV. In this case, the ROV could provide the energy for the display system 120 for days if not months (dependent on the capacity of the ROV that is available). When not activated the USD goes into sleep mode after a predetermined amount of time.

In this way, critical data about the BOP stack, even if it failed, could be accessed and remedies for shutting the well may be implemented. The system is designed that even if some of the sensors are destroyed, the remaining sensors still transmit their measurements to the display panel 116 as long as the sensors can be powered by alternate means. This novel system may also be used to monitor the BOP stack when the MUX POD is disconnected for various reasons. The number of sensors to be monitored by the novel system is not limited. The system can be activated by an ROV even when the MUX Pod is working and the power at that time is provided to the system by the MUX Pod through the RTU 112. Under normal working conditions the battery is trickle charged through the connection to the RTU and keeps it fully charged compensating for any power that is self discharged or any power consumed by different components during the sleep mode.

Figure 6:
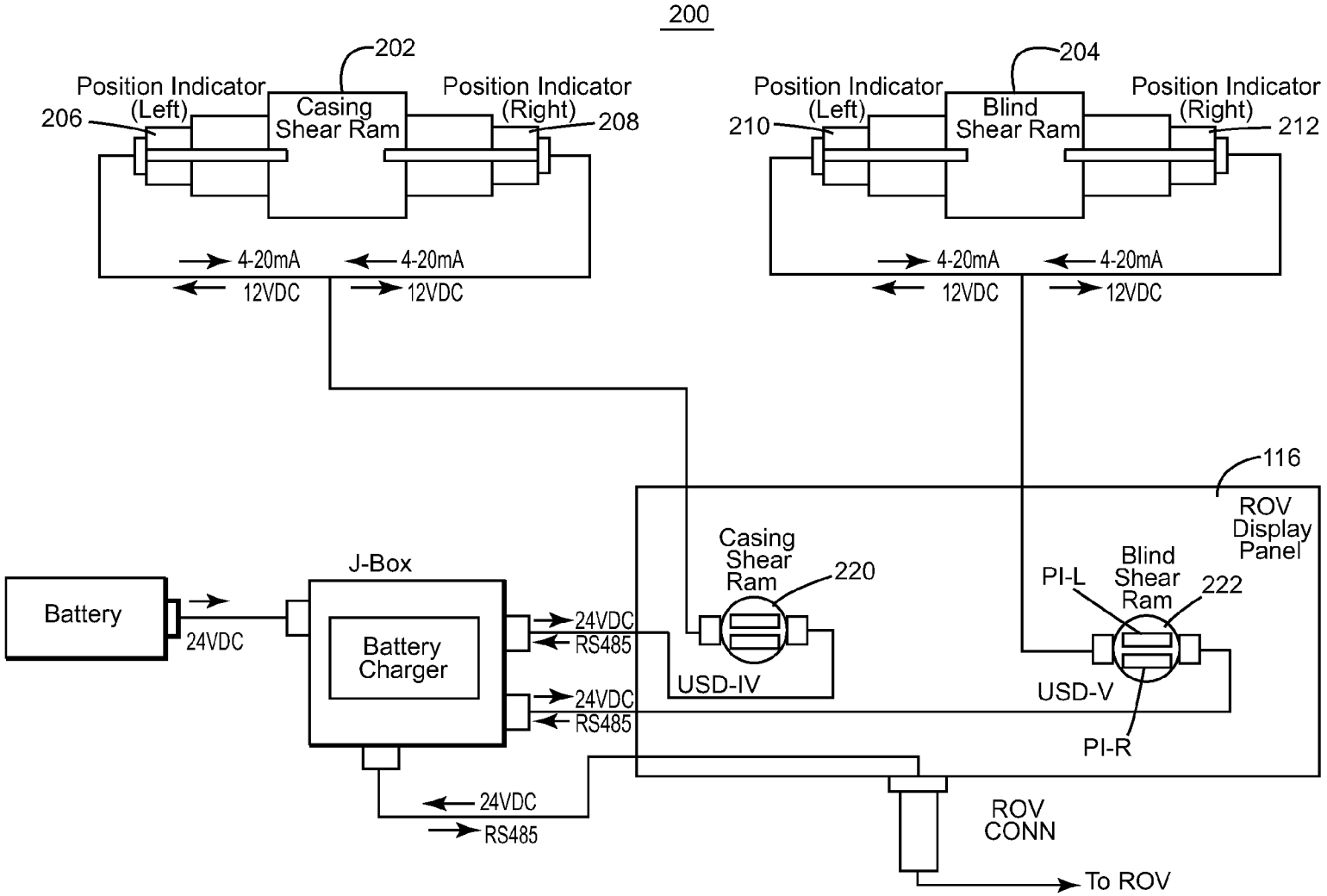
FIG. 6 is another schematic diagram of a novel arrangement for collecting and displaying sensor data according to an exemplary embodiment.

According to another exemplary embodiment illustrated in FIG. 6, a system 200 includes, for example, a cashing shear ram 202 and a blind shear ram 204. More or less or other rams may be present. Position sensors 206 and 208 of the casing shear ram 202 and position sensors 210 and 212 of the blind shear ram 204 monitor the positions of the rams inside these bops. Signal indicative of these positions are provided to the display panel 116 and displayed on USDs 220 and 222. These USDs may be in addition to the USDs shown in FIG. 4, or may be by themselves.

Figure 7:
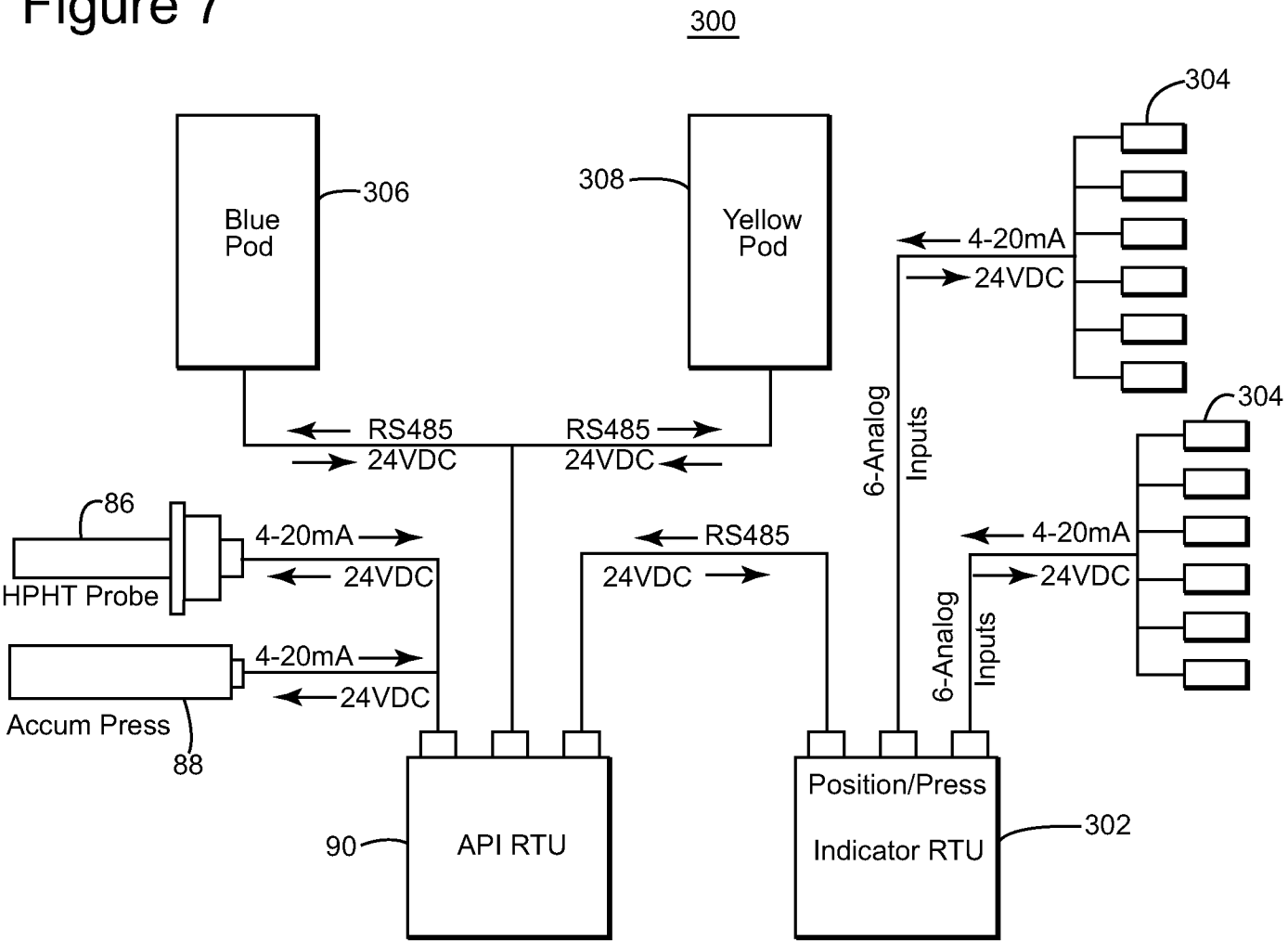
FIG. 7 is a schematic diagram for providing plural data to an operator.

Another embodiment is now discussed with regard to FIGS. 7 and 8. FIG. 7 illustrates a traditional set up 300 in which a position/pressure RTU 302 is used to transmit the signals from a position or position/pressure indicator 304 mounted on a RAM. The RTU 302 converts the analog signals into RS485 signals that can be transferred over long distance, for example, to the operator through the PODs 306 and/or 308. This is achieved by using a series of dedicated modules (known to those skilled in the art) inside the RTU 302. The readings from these sensors can help in determining if a RAM is closed properly and is important in case of an emergency or when experiencing a "kick".

The RTU 302 is connected to RTU 90 (shown in FIG. 3), which may be connected to probes 86 and 88 (also shown in FIG. 3). Thus, position and/or pressure indicators for various RAMs may be integrated with readings from other components of the BOP. However, this set up has the same limitations as the one shown in FIG. 3, i.e., in case that the PODs fail, no information about the BOPs can be provided to the operator.

Figure 10:
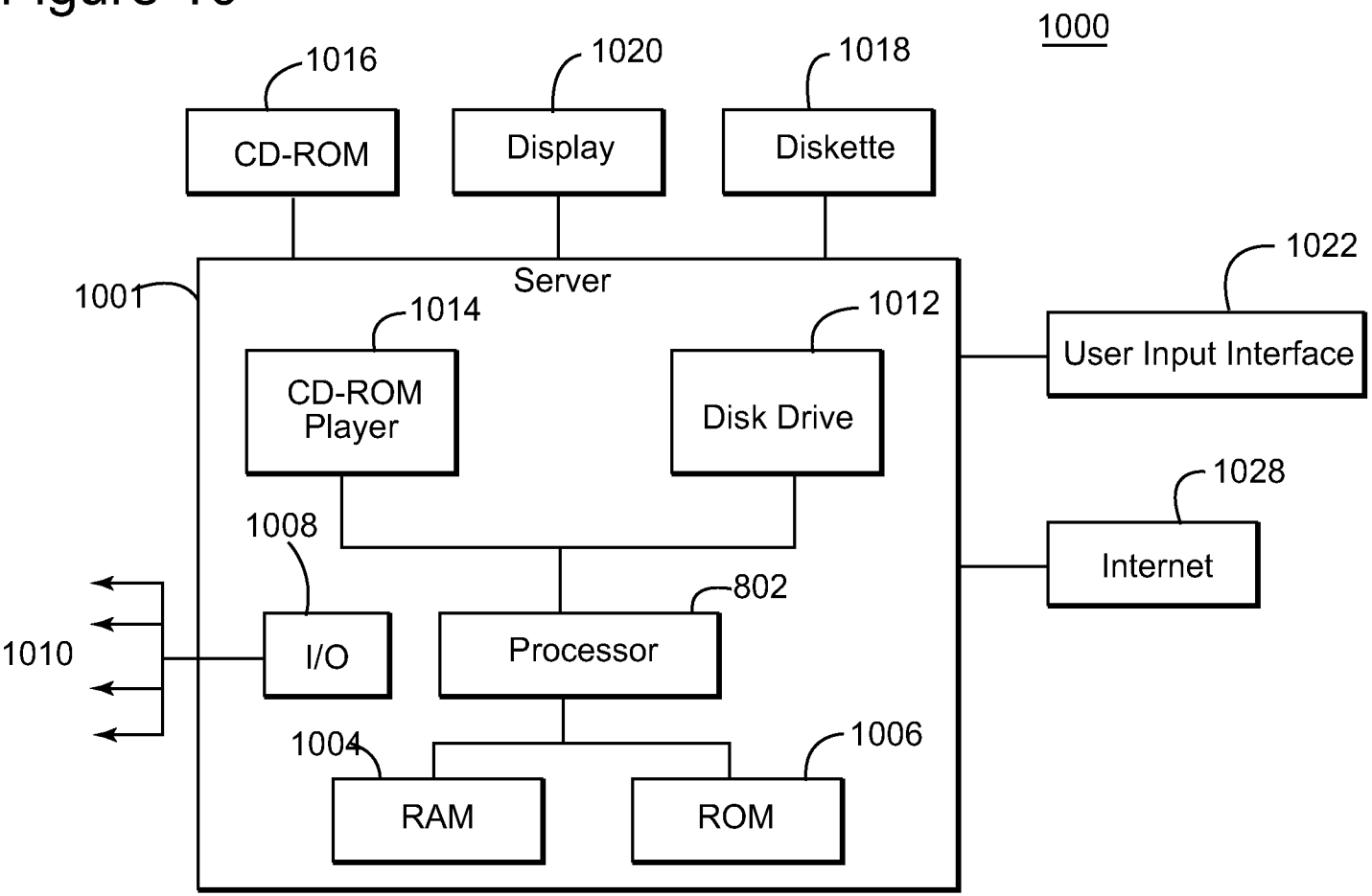
FIG. 10 is a schematic diagram of a control system of a J-box according to an exemplary embodiment.

According to an exemplary embodiment illustrated in FIG. 10, this problem is remedied if a display panel is added to the set up 400. FIG. 10 shows the display panel 402 having six USD, USD-I for wellbore pressure and temperature, USD-2 for accumulator pressure, USD-III for position and pressure for left part of RAM 410, USD-IV the same information for the same RAM 410 but for the right part, USD-V for position and pressure for the left part of RAM 412 and USD-VI the same information for the same RAM 412 but for the right part. Of course, less and more USDs may be used. The number shown in FIG. 10 is not intended to be restrictive. The number of USDs shown in FIG. 10 only reflect that two RAMs 410 and 412 are considered. Of course, another number of RAM may be monitored and/or other parameters of the well.

In the above example, it is shown how readings from the blind RAM 410 and the shear RAM 412 can be used with the subsea display system. Other types of RAM may be used. By manipulating the signals in the RTU 20, e.g., using electrical circuits, the analog signals can be duplicated and one set can be sent to the subsea display panel 402 and read with the help of the USDs while the other set can be sent to a traditional RTU 422 and then to the operator through the PODs (not shown). For reading the position from two of the RAMs on the display panel, four USDs may be used. Each of the USDs read one sensor and displays a position and pressure reading. More USDs will be required to read data from additional RAMs. Various connectors (e.g., 6/36 pie connector) may be used with the RTU 420 for handling the signals. While FIG. 10 shows specific voltages and types of signals, it is noted that this is only an exemplary embodiment and these values are not limiting the application of the novel aspects. FIG. 10 also shows an ROV connection 430 that is configured to mate with a corresponding ROV. Other configurations of the display panel 402 (i.e., less or more USDs) may be envisioned.

Figure 9:
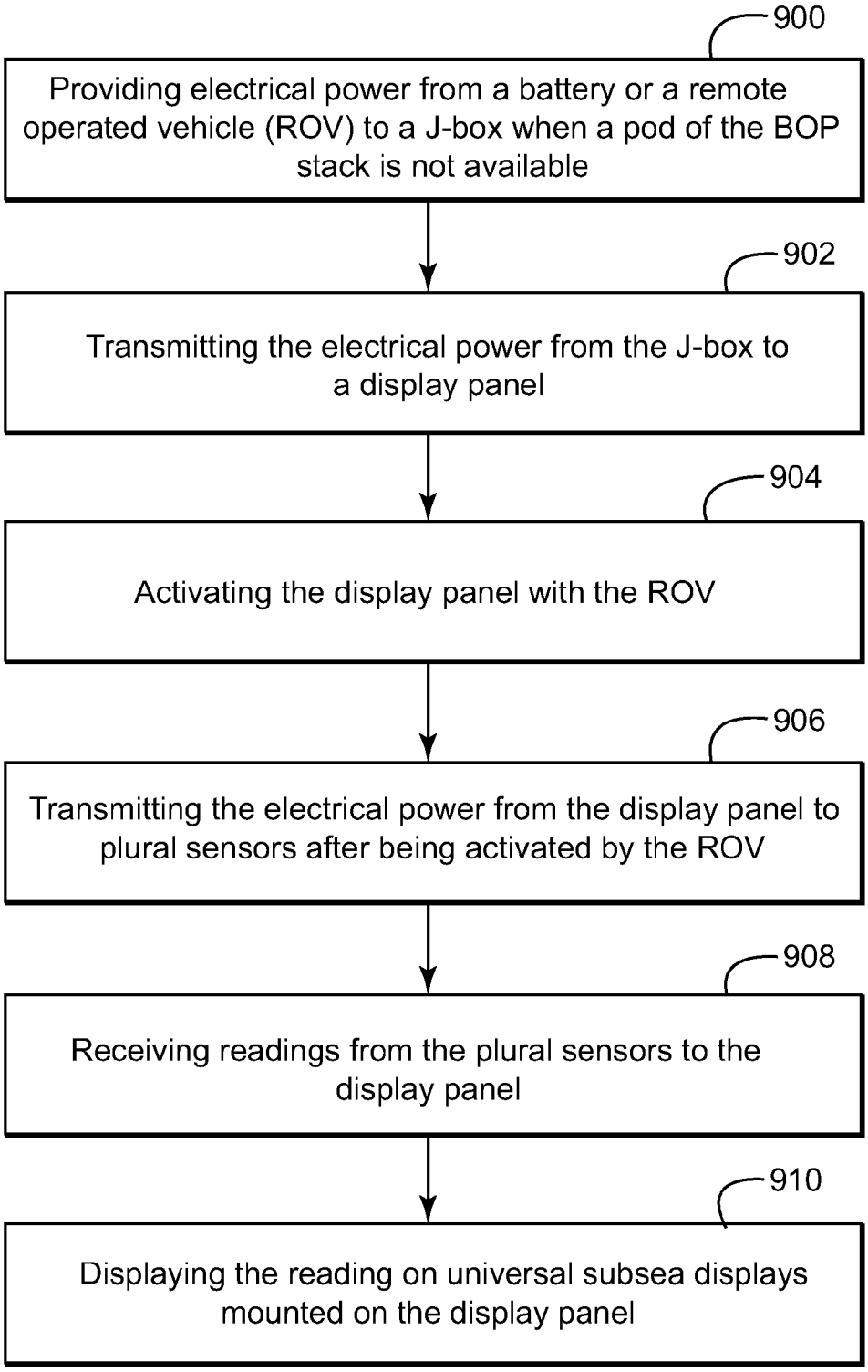
FIG. 9 is a flow chart illustrating a method for displaying sensor data according to an exemplary embodiment.

According to an exemplary embodiment illustrated in FIG. 9, there is a method for displaying measurements associated with sensors provided on a blowout preventer (BOP) stack. The method includes a step 900 of providing electrical power from a battery or a remotely operated vehicle (ROV) to a J-box when a pod of the BOP stack is not available; a step 902 of transmitting the electrical power from the J-box to a display panel; a step 904 of activating the display panel with the ROV; a step 906 of transmitting the electrical power from the display panel to plural sensors after being activated by the ROV; a step 908 of receiving readings from the plural sensors to the display panel; and a step 910 of displaying the reading on universal subsea displays mounted on the display panel.

As discussed above, the J-box may include various hardware, software or a combination of the two for controlling the various elements to which it is connected. An example of a control system capable of carrying out operations in accordance with the exemplary embodiments of FIGS. 4, 6 and 8 is illustrated in FIG. 10. Hardware, firmware, software or a combination thereof may be used to perform the various steps and operations described herein. The control system 1000 of FIG. 10 is an exemplary control system that may be used in connection with such a system.

The exemplary control system 1000 suitable for performing the activities described in the exemplary embodiments may include server 1001, which may include blocks 152 and 154 shown in FIG. 4. Such a server 1001 may include a central processor (CPU) 1002 coupled to a random access memory (RAM) 1004 and to a read-only memory (ROM) 1006. The ROM 1006 may also be other types of storage media to store programs, such as programmable ROM (PROM), erasable PROM (EPROM), etc. The processor 1002 may communicate with other internal and external components through input/output (I/O) circuitry 1008 and bussing 1010, to provide control signals and the like. The processor 1002 carries out a variety of functions as is known in the art, as dictated by software and/or firmware instructions.

The server 1001 may also include one or more data storage devices, including hard and floppy disk drives 1012, CD-ROM drives 1014, and other hardware capable of reading and/or storing information such as DVD, etc. In one embodiment, software for carrying out the above discussed steps may be stored and distributed on a CD-ROM 1016, diskette 1018 or other form of media capable of portably storing information. These storage media may be inserted into, and read by, devices such as the CD-ROM drive 1014, the disk drive 1012, etc. The server 1001 may be coupled to a display 1020, which may be any type of known display or presentation screen, such as LCD displays, plasma display, cathode ray tubes (CRT), etc. A user input interface 1022 is provided, including one or more user interface mechanisms such as a mouse, keyboard, microphone, touch pad, touch screen, voice-recognition system, etc.

The disclosed exemplary embodiments provide a display system and a method for providing information regarding a BOP stack when the MUX POD is not available. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A subsea sensors display system configured to display data about a blowout preventer (BOP) stack, the subsea sensors display system comprising:

a display panel having plural universal subsea displays, each universal subsea display being configured to display a value measured by a sensor attached to the BOP stack;

a J-box electrically connected to the display panel and configured to provide electrical power to the display panel and to receive data from the display panel; and a pod provided on the BOP stack for providing electrical power to the J-box under normal operating conditions, wherein the electrical power is provided from the pod under normal operating conditions, and from a battery when the pod is not available or from a remote operated vehicle (ROV) when connected to the display panel when the pod is not available.

2. The subsea sensor display system of claim 1, further comprising:

the battery which is configured to be charged by the J-box when the pod is available and to provide the electrical power to the display panel when the pod is not available.

3. The subsea sensor display system of claim 1, wherein at least one universal subsea display is Configured to provide the electrical power to sensors of the BOP stack.

4. The subsea sensor display system of claim 1, further comprising:

a wet-mate connector attached to the display panel and configured to connect to the ROV.

5. The subsea sensor display system of claim 1, wherein the display panel is configured to become inactive after a predetermined amount of time to conserve power.

6. The subsea sensor display system of claim 1, wherein the display panel is configured to become active when light is shined on it.

7. The subsea sensor display system of claim 6, wherein the display panel is configured to power up plural sensors When activated and display on the universal subsea displays values associated with the sensors.

8. The subsea sensor display system of claim 1, further comprising:

the sensors, wherein at least one sensor is connected to the pod and at least one sensor is connected to the display panel.

9. The subsea sensor display system of claim 8, wherein the sensors are configured to determine at least one of pressure, temperature, distance, or position.

10. The subsea sensor display system of claim 1, wherein data from the plural universal subsea displays is provided to the J-box and then to a wet-mate connector configured to connect to the ROV.

11. The subsea sensor display system of claim 1, wherein the display panel and the J-box are provided on a BOP stack.

12. A subsea sensors display system configured to display data about a blowout preventer (BOP) stack, the subsea sensors display system comprising:

a display panel having plural universal subsea displays, each universal subsea display being configured to display a value measured by a sensor attached to the BOP stack;

a J-box electrically connected to the display panel and configured to provide electrical power to the display panel and to receive data from the display panel;

a pod provided on the BOP stack for providing electrical power to the J-box under normal operating conditions;

a battery connected to the J-box; and plural sensors connected to the display panel, wherein the electrical power is provided from the pod under normal operating conditions, and from the battery when the pod is not available or from a remote operated vehicle (ROV) when connected to the display panel when the pod is not available.

13. The system of claim 12, wherein the J-box is configured to detect when the pod fails and automatically provide the electrical power from the battery to the display panel and the sensors.

14. The system of claim 12, wherein at least one universal subsea display is configured to provide the electrical power to the sensors of the BOP stack.

15. The system of claim 12, further comprising:

a wet-mate connector attached to the display panel and configured to connect to the ROV.

16. The system of claim 12, wherein the display panel is configured to become inactive after a predetermined amount of time to conserve power.

17. The system of claim 12, wherein the display panel is configured to become active when light is shined on it.

18. The system of claim 17, wherein the display panel is configured to power up the sensors when activated and display on the universal subsea displays values associated with the sensors.

19. A method for displaying measurements associated with sensors provided on a blowout preventer (BOP) stack, the method comprising:

providing electrical power from a battery or a remotelv operated vehicle (ROV) to a J-box when a pod of the BOP stack is not available;

transmitting the electrical power from the J-box to a display panel;

activating the display panel with the ROV;

transmitting the electrical power from the display panel to plural sensors after being activated by the ROV;

receiving readings from the plural sensors to the display panel; and displaying the reading on universal subsea displays mounted on the display panel.

20. A non-transitory computer readable medium including computer executable instructions, wherein the instructions, when executed, implement a method for displaying measurements associated with sensors provided on a blowout preventer (BOP) stack, the method comprising:

providing electrical power from a batter or a remove operated vehicle (ROV) to a J-box when a pod of the BOP stack is not available;

transmitting the electrical power from the J-box to a display panel;

activating the display panel with the ROV;

transmitting the electrical power from the display panel to plural sensors after being activated by the ROV;

receiving readings from the plural sensors to the display panel; and displaying the reading on universal subsea displays mounted on the display panel.

* * * * *